US008840454B2

(12) United States Patent
Ikari et al.

(10) Patent No.: US 8,840,454 B2
(45) Date of Patent: Sep. 23, 2014

(54) SHUTTER DEVICE AND VENTILATION DEVICE

(75) Inventors: Yoshio Ikari, Aichi (JP); Takashi Tonokakiuchi, Aichi (JP); Makoto Ishikawa, Aichi (JP); Hideyuki Fujisawa, Aichi (JP); Nobuyuki Yasui, Gifu (JP); Kunio Kiyomoto, Aichi (JP)

(73) Assignee: Panasonic Corporation, Osaka (JP)

( * ) Notice: Subject to any disclaimer, the term of this patent is extended or adjusted under 35 U.S.C. 154(b) by 1083 days.

(21) Appl. No.: 12/391,675

(22) Filed: Feb. 24, 2009

(65) Prior Publication Data

US 2009/0163132 A1 Jun. 25, 2009

Related U.S. Application Data

(63) Continuation of application No. PCT/JP2007/067563, filed on Sep. 10, 2007.

(30) Foreign Application Priority Data

Sep. 14, 2006 (JP) ..... 2006-249087

(51) Int. Cl.

| | |
|---|---|
| ***A24F 13/08*** | (2006.01) |
| ***F04D 25/14*** | (2006.01) |
| ***F24F 11/04*** | (2006.01) |
| ***F24F 7/007*** | (2006.01) |

(52) U.S. Cl.

CPC ..... *F24F 11/043* (2013.01); *F04D 25/14* (2013.01); *F24F 7/007* (2013.01)

USPC ..... 454/284

(58) Field of Classification Search

USPC ..... 454/284

See application file for complete search history.

(56) References Cited

U.S. PATENT DOCUMENTS

| | | | | |
|---|---|---|---|---|
| 2004/0154615 | A1* | 8/2004 | Komano et al. | 126/629 |
| 2005/0202291 | A1* | 9/2005 | Schweizer | 429/13 |

FOREIGN PATENT DOCUMENTS

| | | | |
|---|---|---|---|
| JP | H8-075212 | A | 3/1996 |
| JP | H9-014743 | A | 1/1997 |
| JP | 2003-056893 | A | 2/2003 |
| JP | 2003-065581 | A | 3/2003 |

OTHER PUBLICATIONS

International Search Report of PCT Application No. PCT/JP2007/067563 dated Dec. 11, 2007.

* cited by examiner

*Primary Examiner* — Kang Hu
*Assistant Examiner* — Samantha Miller
(74) *Attorney, Agent, or Firm* — Panasonic Patent Center

(57) ABSTRACT

A shutter device reduces resistance in an air passage while maintaining air-tightness, thus reducing a load to a fan and a motor. A shutter mount is provided between an intake port adapted to be connected with a side from which air enters and a discharging port adapted to be connected with a side from which air is discharged. A shutter frame is inserted into an inside of the shutter mount. A shutter for preventing outside air from entering from the discharging port is mounted to the shutter frame. The shutter mount has a rib thereof for sealing a gap produced between the shutter and the shutter mount when the shutter is closed. The rib has an inner diameter substantially equal to a diameter of the discharging port as seen from the discharging port.

19 Claims, 6 Drawing Sheets

SHUTTER DEVICE AND VENTILATION DEVICE

TECHNICAL FIELD

The present invention relates to a shutter device comprising an intake port adapted to be connected with a side into which air enters, a discharging port adapted to be connected with a side from which the air is discharged, and a shutter prevents outside air from entering from the discharging port, and to a ventilation device including the shutter device.

BACKGROUND OF THE INVENTION

Shutter devices are installed in ventilation devices for discharging air from a duct communicating with an outside (see Patent Document 1).

A conventional shutter device will be described with referring to FIGS. 6 and 7 below. FIG. 6 is a schematic view of the conventional shutter device. FIG. 7 is a front view of the shutter device.

As shown in FIGS. 6 and 7, the conventional shutter device includes an intake port 101 for having air entering therein, a discharging port 102 adapted to be connected with a side from which the air is discharged, a shutter 104 for blocking the air from an outside, and an adapter 105 including shutter support shafts 103 having the shutter 104 mounted thereto. The shutter device further includes a rib 106 operable to contact shutter 104 to seal a gap produced between the shutter 104 and an inner side of the discharging port 102 of the adapter 105 when the shutter 104 is closed. Rib 106 contacts an upper end of the shutter 104 at a side of the intake port 101, and contacts a lower end of the shutter 104 at a side approximating to the discharging port 102 with respect to the shutter support shafts 103. Rib 106 protrudes toward an inside of the discharging port 102, i.e., an air passage, at the side of the discharging port 102.

In the conventional shutter device, the rib 106 contacts the shutter 104 and seals the gap for improving air tightness when the shutter is closed. However, the rib 106 protrudes inward towards the air passage as seen from the front at the discharging port while the shutter opens. This arrangement increases the resistance in the air passage thus interrupting the flow of the air. For ensuring the desired flow of the air, the load to a fan and a motor increases for producing a large output. It is hence required to reduce the load to the fan and the motor while maintaining a desired level of the air-tightness.

Patent Document 1: JP2003-065581A

SUMMARY OF THE INVENTION

The present invention is to solve the foregoing problem and provides a shutter device having a small resistance in an air passage while maintaining a desired level of the air-tightness, thus reducing a load to a fan and a motor.

A shutter device includes an intake port adapted to be connected with a side into which air enters. a discharging port adapted to be connected with a side from which air is discharged, a shutter mount provided between the intake port and the discharging port, the shutter mount having an inner diameter larger than a diameter of the discharging port, a shutter for preventing air from entering from the discharging port, and a shutter frame inserted into an inside of the shutter mount so as to mount the shutter within a step provided between the intake port and the discharging port, a shutter support shaft provided at the step, the shutter support shaft supporting the shutter. The shutter frame includes a rib which contacts the shutter when the shutter is closed, so that the rib closes a gap between the shutter and the shutter mount. An upper end of the rib is located at a side of the intake port with respect to the shutter support shaft. A lower end of the rib is located at a side of the discharging port with respect to the shutter support shaft. Portions of the rib which contact the shutter are positioned in an area from the step to the intake port within a range from the upper end to the step. Positions of portions of the rib which contact the shutter are positioned in an area from the step to the discharging port within a range from the lower end to the step.

While the shutter opens, the rib of the shutter frame does not prevent air from flowing in an air passage, as seen from the discharging port. Therefore, the shutter device has a large area of the air passage thus contributing to the effective use of the air passage and reducing resistance in the air passage.

A ventilation device includes the shutter device and a duct connected with the discharging port of the shutter device. The intake port of the shutter device is connected with an exhausting opening for ventilation. The shutter device according to the present invention maintains air-tightness and reduces a resistance in the air passage, accordingly reducing a load to a fan and a motor.

REFERENCE NUMERALS

Figure 1:
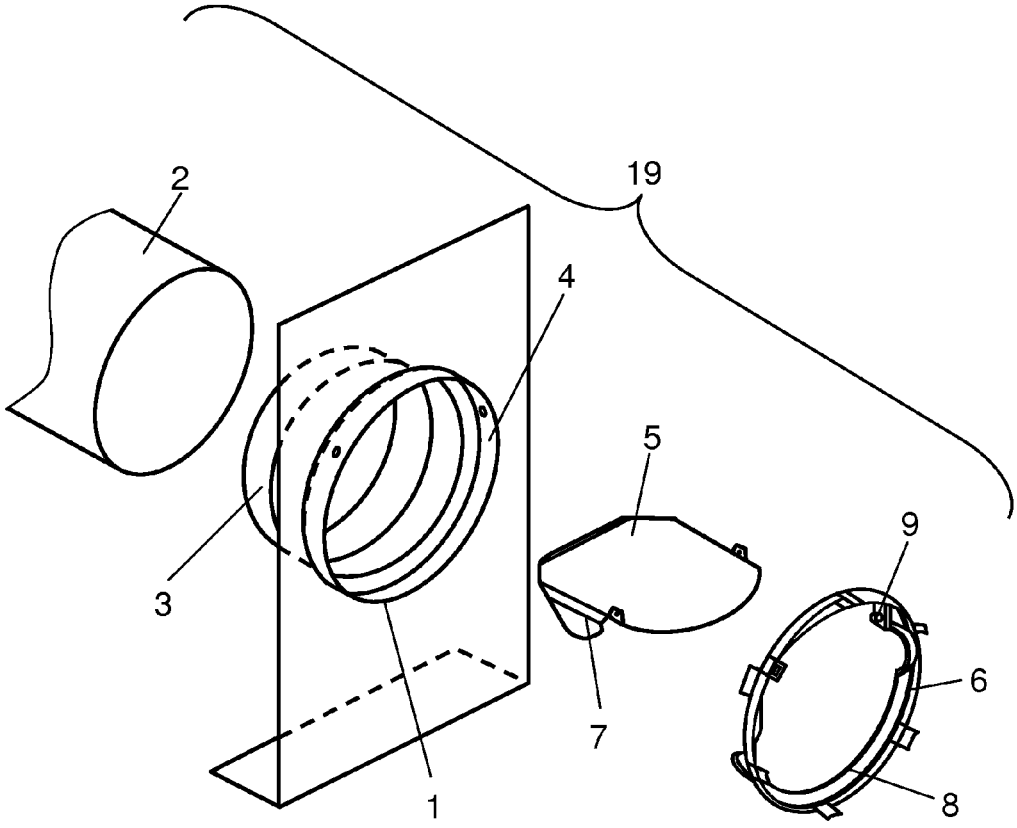
FIG. 1 is an exploded perspective view of a shutter device according to an exemplary embodiment of the present invention.

1 Intake Port
2 Duct
3 Discharging Port
4 Shutter Mount
5 Shutter
6 Shutter Frame
7 Curved Portion
8 Rib
9 Shutter Support Shaft
10 Round Edge
11 Contact Rib Portion
12 Over-Ceiling Space
13 Intake Opening
14 Ceiling Board
15 Fitting Opening
16 Outside
17 Ventilation device
19 Shutter Device
20 Burring Region
21 Insertion Aperture

DETAIL DESCRIPTION OF THE PREFERRED EMBODIMENT

A shutter device according to the present invention includes an intake port adapted to be connected with a side into which air enters, a discharging port adapted to be connected with a side from which air is discharged, a shutter mount provided between the intake port and the discharging port, the shutter mount having an inner diameter larger than a diameter of the discharging port, a shutter for preventing air from entering from the discharging port, a shutter frame inserted into an inside of the shutter mount so as to mount the shutter within a step provided between the intake port and the discharging port, and a shutter support shaft provided at a portion of the step, the shutter support shaft supporting the shutter. The shutter frame includes a rib which contacts the shutter when the shutter is closed, so that the rib closes a gap between the shutter and the shutter mount. An upper end of the rib is located at a side of the intake port with respect to the shutter support shaft. A lower end of the rib is located at a side of the discharging port with respect to the shutter support shaft. Portions of the rib which contact the shutter are positioned in an area from the step to the intake port within a range from the upper end to the step provided between the intake port and the discharging port. Portions of the rib which contact the shutter are positioned in an area from the step to the discharging port within a range from the lower end to the step provided between the intake port and the discharging port. While the shutter opens, the rib of the shutter frame does not prevent air from flowing in an air passage, as seen from the discharging port. Therefore, the shutter device has a large area of the air passage and reduces a resistance in the air passage thus contributing to the effective use of the air passage.

According to an aspect of the present invention, the shutter may have curved portions provided at left and right sides of the shutter. The curved portions have shapes fitting a diameter of the discharging port when the shutter opens as seen from the discharging port. The shutter frame may include contact rib portions having shapes matching with outer edges of the curved portions, the contact rib portions contacting the curved portions when the shutter is closed. Since the left and right sides of the shutter is curved, the shutter has an area larger than the air passage or the inner diameter of the duct, accordingly having a large area receiving air. A force due to a pressure of the air for opening the shutter operates efficiency and can open the shutter with a small force. That is, the shutter device can reduce a shutter resistance.

According to an aspect of the present invention, the curved portions of the shutter may match with the contact rib portions when the shutter is closed. When the shutter is closed and urged directly by the outside air, a force for pressing the shutter against the shutter frame is produced thus allowing the shutter to contact the rib of the shutter frame by surface-to-surface. This arrangement provides the shutter device with reliable shuttering effect.

According to an aspect of the present invention, an outer edge of each of the curved portions of the shutter may have a shape asymmetrical about an axis which extends on a vertex of an outer edge of the curved portion and which is perpendicular to a surface of the shutter as seen from a side of the shutter. A portion of the outer edge of each of the curved portions in a side including the shutter support shaft with respect to the axis may have a smaller curvature radius. Since the shape of each curved portion of the shutter is asymmetrical about the axis, it allows air to flow along a large radius region of the curved portion after hitting against the shutter frame of a curve shape and to concentrate on the region farther away from the shutter support shaft of the shutter. This increases a force or a torque produce by the pressure of the air for opening the shutter. Accordingly the shutter device allows the shutter to open easily and reduces a kinetic resistance to the opening of the shutter.

According to an aspect of the present invention, the shutter may be made of metal material. If the shutter is made of resin, its thickness influences a flow of injection molding of the resin. If the shutter is thin, the resin is prevented from flowing, thus not making the shutter. However, the shutter made of metal can have a smaller thickness than the shutter made of resin since the thickness is determined by the thickness of the metal. This reduces the thickness of the shutter hit by air while the shutter opens, accordingly reducing a resistance in the air passage of the shutter device.

According to an aspect of the present invention, the shutter may be made of metal. The shutter may have an insertion aperture provided therein, the shutter support shaft being inserted into the insertion aperture. The insertion aperture may have a shape such that a burr produced when the insertion aperture is formed does not contact the shutter support shaft. When the support shaft insertion aperture contacts the shutter support shaft while the shutter rotates, the shaft does not contact a burr produced at the fabrication of the shutter made of metal. Accordingly the shutter device can reduce a frictional resistance during the opening and closing of the shutter or the kinetic resistance during the movement of the shutter.

According to an aspect of the present invention, a packing may be wound or bonded with an outer edge of the shutter located in a direction perpendicular to an axis of the shutter support shaft, the packing adapted to absorb a collision. The packing may be bonded to the outer edge of the shutter so as to extend from the front side to the back side, and absorb noise of collision generated by the collision between the shutter and the rib of the shutter frame when the shutter is closed.

According to an aspect of the present invention, the shutter may be made of resin. The shutter can be made of the substantially same amount of resin material as the shutter for resin molding, thereby hence reducing waste of the material and reducing the overall cost of the shutter device.

According to an aspect of the present invention, the shutter mount and the shutter frame may be formed unitarily. This arrangement allows both the shutter frame and the shutter mount to be implemented by a single component, and reduces the number of the components by at least one, thus reducing the number of assembling processes of the shutter device.

According to an aspect of the present invention, a ventilation device includes the shutter device according to the present invention and a duct connected with the discharging port of the shutter device. The intake port of the shutter device connected with an exhausting opening for ventilation. The shutter device according to the present invention maintains air-tightness and reduces a resistance in the air passage, accordingly reducing a load to a fan and a motor.

An exemplary embodiment of the present invention will be described in detail with referring to the relevant drawings.

Exemplary Embodiment

Figure 2:
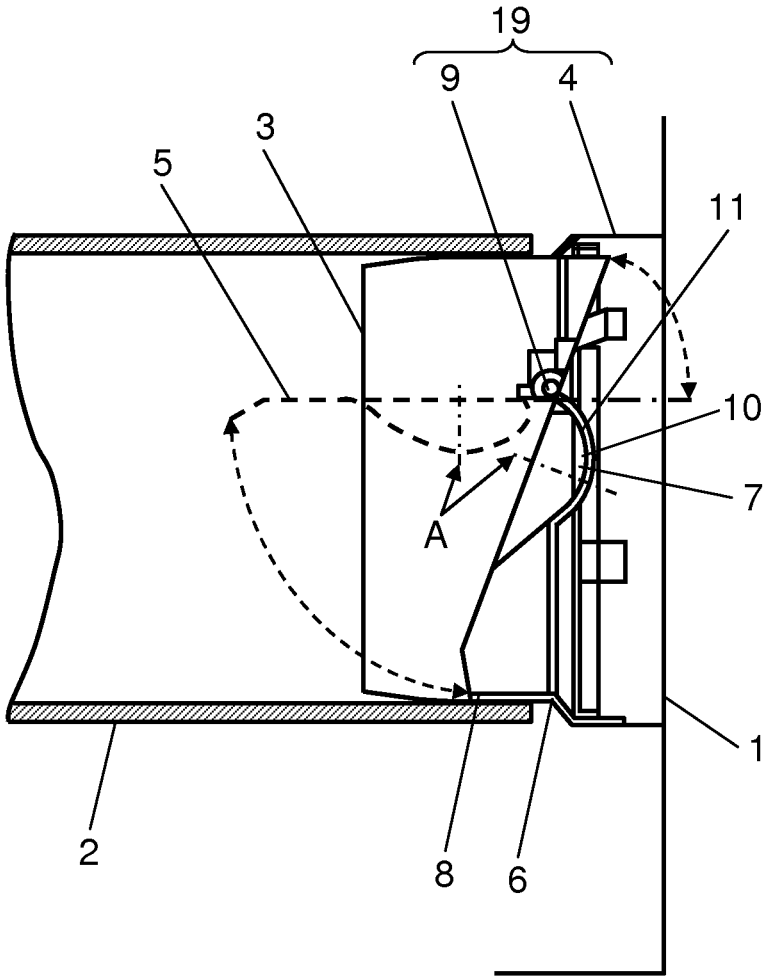
FIG. 2 is a cross sectional view of the shutter device.
Figure 3:
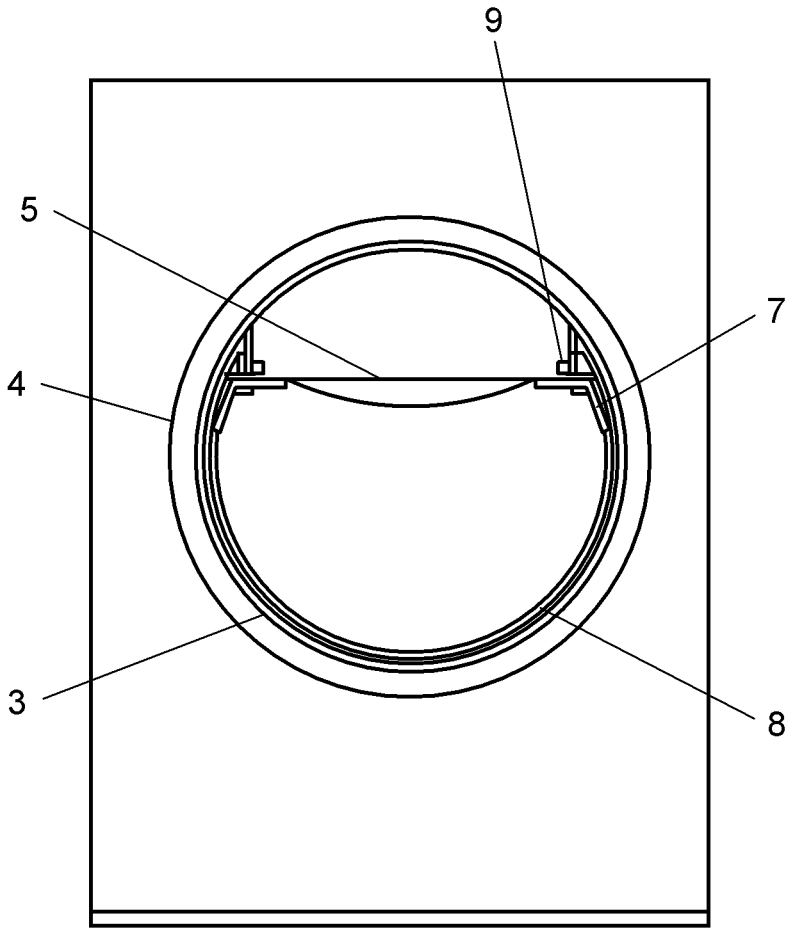
FIG. 3 is a front view of the shutter device while a shutter opens.
Figure 4:
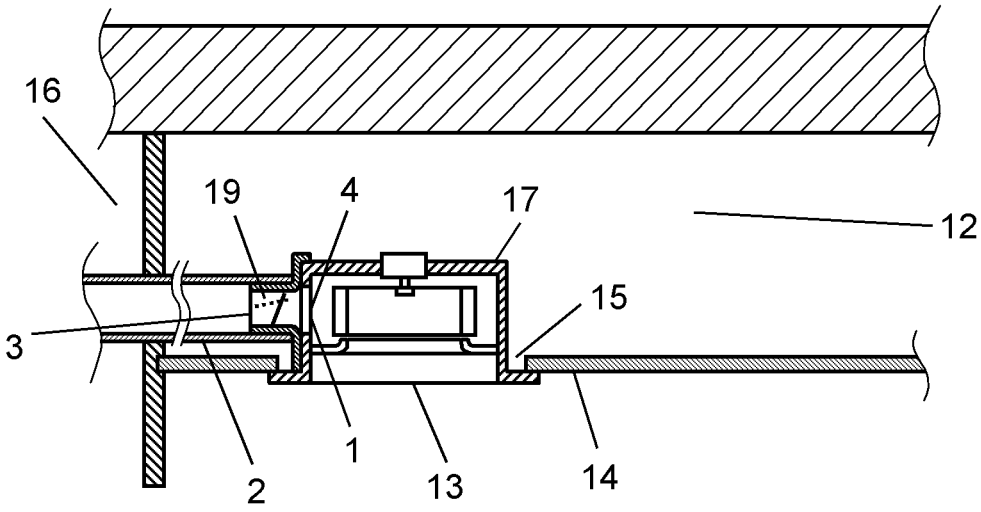
FIG. 4 is a cross sectional view of the shutter device which is installed.
Figure 5:
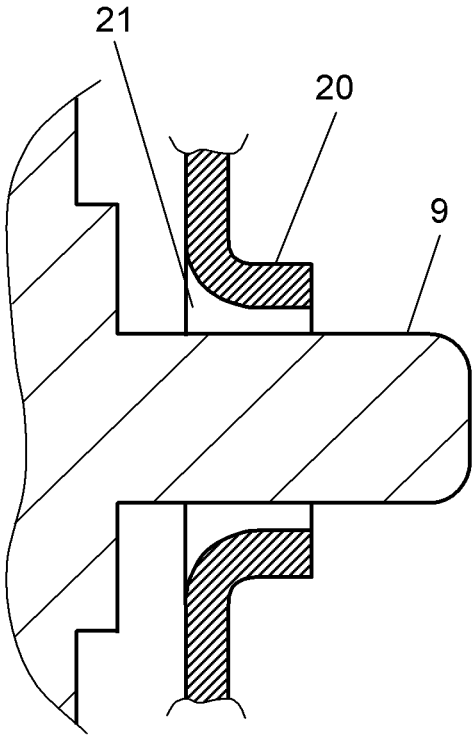
FIG. 5 is an enlarged cross sectional view of the shutter device for illustrating a shutter support shaft which is inserted.
Figure 6:
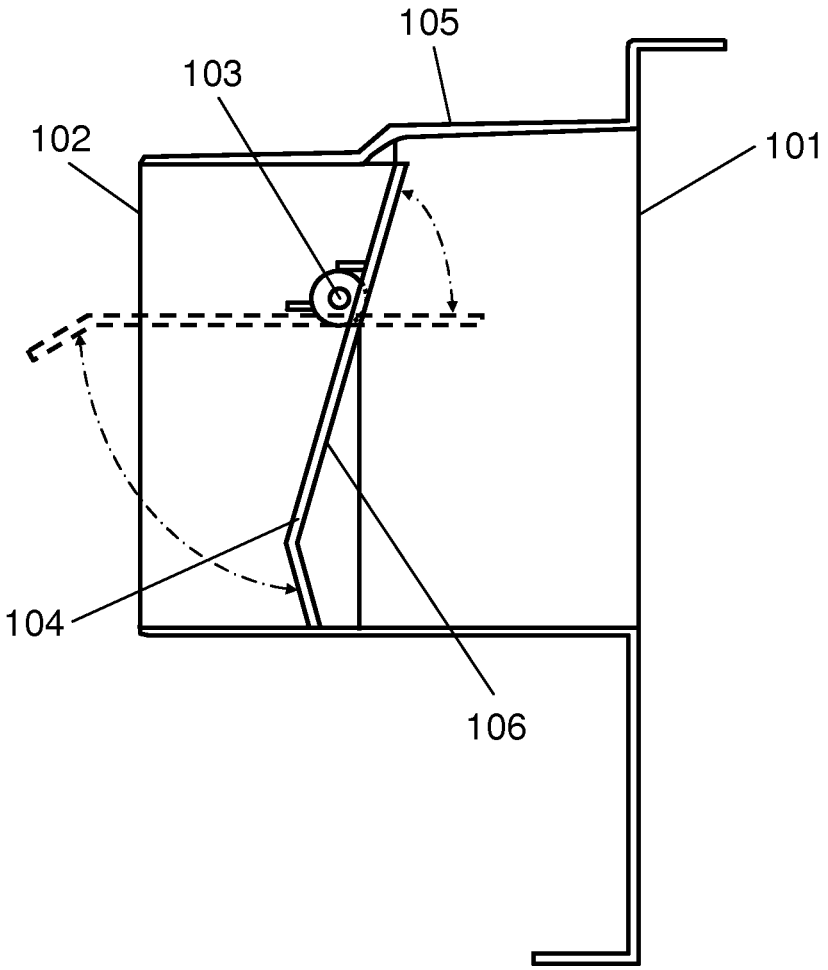
FIG. 6 PRIOR ART
FIG. 6 is a schematic view of a conventional shutter device.
Figure 7:
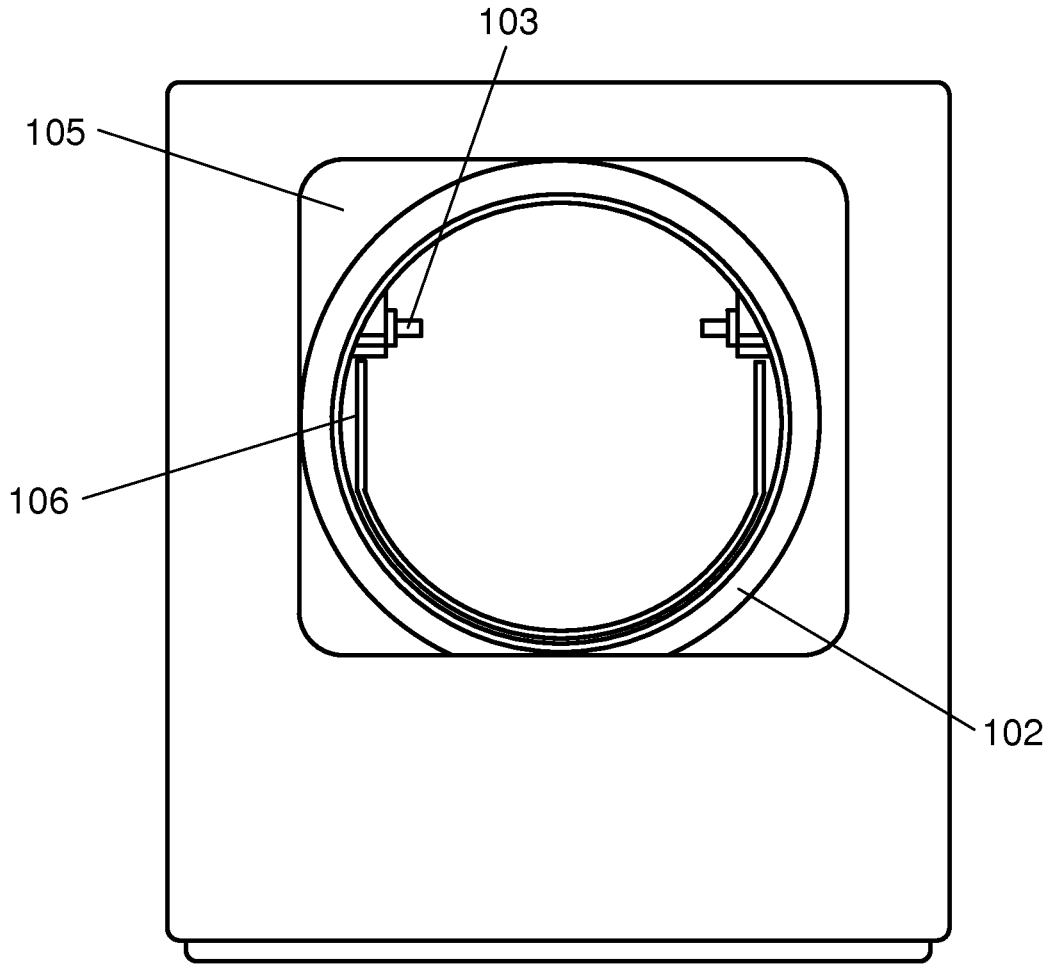
FIG. 7 PRIOR ART
FIG. 7 is a front view of the conventional shutter device.

FIG. 1 is an exploded perspective view of a shutter device according to an exemplary embodiment of the present invention. FIG. 2 is a cross sectional view of the shutter device. FIG. 3 is a front view of the shutter device while a shutter opens. FIG. 4 is a cross sectional view of the shutter device which is installed. FIG. 5 is an enlarged cross sectional view of the shutter device for illustrating a shutter support shaft which is inserted.

As shown in FIG. 4, a ventilation device 17 has a lower surface having an exhaust opening provided therein. At least one blower sucks air from intake opening 13 and sends the air to an exhaust opening which is connected to intake port 1 of shutter device 19. The ventilation device 17 is inserted into a fitting opening 15 provided in a ceiling board 14 and extends over-ceiling space 12 so that a discharging port 3 of the shutter device 19 communicates with a duct 2 for discharging the air to an outside 16.

As shown in FIGS. 1 and 2, the shutter device 19 installed in the ventilation device 17 includes the intake port 1 adapted to be connected with a side into which air flows, the discharging port 3 adapted to be connected with a side from which the air is discharged, and a shutter mount 4 provided between the intake port 1 and the discharging port 3. Shutter mount 4 has a diameter larger than an inner diameter of the discharging port 3. Shutter device 19 further includes a shutter frame 6 which is fit-inserted into an inside of the shutter mount 4 and which is situated at a step provided between the shutter mount 4 and the discharging port 3 which have diameters different from each other. A shutter 5 for preventing outside air from entering through the discharging port 3 is mounted to shutter frame 6. Shutter support shafts 9 for supporting the shutter 5 are provided at the step produced by the difference between respective diameters of the discharging port 3 and the shutter mount 4. Upon the shutter 5 being closed, a gap is produced between the shutter 5 and the shutter mount 4. Upon the shutter 5 being closed, rib 8 of the shutter frame 6 contacts the shutter 5 to seal the gap. An upper end of rib 8 is located at a side of the intake port 1 with respect to the shutter support shafts 9. A lower end of rib 8 is located at a side of the discharging port 3 with respect to the shutter support shafts 9. The lower end of rib 8 protrudes toward an inside of the discharging port 3 by the thickness of the rib 8. The positions of portions of the rib 8 which contact the shutter within a range of the rib 8 between the upper end and the lower end of the rib 8 change, at the step as a border, between in an area from the step to the intake port 1 and in an area from the step to the discharging port 3.

As shown in FIG. 3, the shutter 5 has curved portions 7 provided at left and right sides of the shutter 5. The curved portions 7 are provided by bending the shutter 5, and substantially fit the inner diameter of the discharging port 3 as seen from the discharging port 3 when the shutter 5 opens. The rib 8 of the shutter frame 6 has contact rib portions 11 which contact shutter 5 when shutter 5 is closed. Each of rib portions 11 has a round shape which matches with an outer line of curved portion 7 and which has a vertex directed from the step towards the intake port 1.

The shutter 5 is made of metal. As shown in an enlarged cross sectional view of FIG. 5, shutter 5 has a burring region 20 provided at each side thereof. Burring region 20 extends toward an inside of the shutter 5 so as to prevent the shutter support shaft 9 from contacting burrs which may be produced when insertion aperture 21 is formed in the shutter 5. The burring region may be replaced by a curled portion which may be produced by a curling process, providing the same effects.

The curved portions 7 provided at the left and right sides of the shutter 5 contact the contact rib portions 11 of the shutter frame 6 when shutter 5 is closed. Contact rib portion 11 contacts a surface of curved portion 7 which is parallel with contact rib portion 7 and which is opposite to the surface of curved portion 7 receiving air from an outside.

The shape of round edge 10 of each of the curved portions 7 provided at the left and right sides of the shutter 5 is asymmetric about an axis A which extends on the vertex of the round edge 10 and which is perpendicular to a surface of the shutter 5, as seen from a longitudinal direction of the duct 2, namely from the side. More particularly a portion of the round edge 10 extending from the axis A and including the shutter support shaft 9 has a smaller curvature radius. The shapes of contact rib portions 11 of the rib 8 of the shutter frame 6 match with the shapes of round edges 10 of curved portions 7 provided at the left and right sides of the shutter 5.

The shape at a back side of the contact rib portion 11 substantially matches with the round edge 10 of the curved portions 7.

When the shutter 5 is closed upon receiving outside air, shutter 5 contacts the rib 8 of the shutter frame 6. A packing may be provided on the shutter 5. The packing is located between shutter 5 and rib 8 so as to absorb a collision between shutter 5 and rib 8. The packing is mounted by winding or bonding onto outer edges of the shutter 5 along a direction perpendicular to an axis of the shutter support shafts 9. The packing may be mounted to both the upper and lower edges of the shutter 5. The packing is not shown in drawings.

The shutter 5 may be made of resin, providing the same effects.

The shutter mount 4 is provided between the intake port 1 and the discharging port 3 and has the inner diameter larger than the diameter of the discharging port 3. The shutter 5 prevents outside air from entering from the discharging port 3. The shutter device may include shutter frame 6 which is situated on the inner surface of the shutter mount 4 and which has the shutter 5 mounted thereto, providing the same effects.

When the blower provided in the ventilation device 17 is stopped, outside air entering through the duct 2 towards the ventilation device 17 applies, to shutter 5 which is closed, a force toward the shutter frame 6. At this moment, the shutter 5 contacts the rib 8 and the rib contact portions 11 of the shutter frame 6 tightly by surface-to-surface contact, thereby preventing the outside air from entering though the gap.

When the blower in the ventilation device 17 operates to discharge inside air from the duct 2 to outside 16, the pressure of the air opens the shutter 5. The rib 8 of the shutter frame 6 and the rib contact portions 11 have diameters substantially identical to the diameter of the discharging port 3 in the air passage, as seen from the discharging port 3. In other words, the rib 8 and the rib contact portions 11 do not protrude inside the air passage, and do not prevents the inside air from flowing. Thus, the rib 8 and the rib contact portions 11 maintain the area in the cross section of the air passage, ensure effective use of the air passage, and reduce resistance in the air passage.

When the blower in the ventilation device 17 operates, the pressure of the air opens the shutter 5. Since the shutter 5 is curved at both left and right sides, the size of shutter 5 is larger than the cross section of the air passage or the duct 2. This arrangement allows an area of the shutter 5 receiving air to be larger than the area of the cross section of the air passage, thus increasing the pressure of the air for opening the shutter 5. More particularly the shutter 5 can be opened reliably by the force of the pressure more effectively.

Insertion apertures 21 in shutter 5 made of metal have the burring regions by a burring process, and prevent any burr produced on inner edge of apertures 21 by a simple punching process from being directed toward the shutter support shafts 9. This structure reduces a direct contact between the shutter 5 and shutter support shafts 9, and reduces frictional resistance, i.e., physical resistance preventing the shutter from opening.

While the blower in the ventilation device 17 is stopped so as to close the shutter 5, the shutter 5 receives outside air at a shutter surface thereof and urged by the pressure of the outside air toward the shutter frame 6. The shutter 5 then contacts the rib 8 of the shutter frame 6 by surface-to-surface contact, thereby preventing the outside air reliably from entering.

While the blower in the ventilation device 17 operates, the blower causes air to flow toward the shutter 5. Since round edge 10 of the shutter 5 has the asymmetrical shape, the air flowing toward shutter 5 hits the portion of shutter frame 6 having shapes matching with the shape of round edge 10, and then, flows along a portion of round edge 10 having a larger curvature radius. Then, the air concentrates onto a portion of a surface of shutter 5 farther away from the shutter support shafts 9, and accordingly increases a torque, a force for opening the shutter 5, thus easily opening the shutter 5. That is, resistance to the opening of the shutter 5 is reduced.

When shutter 5 is closed upon receiving the outside air, the shutter 5 contacts the rib 8 of the shutter frame 6 and may produce noise of collision. However, the packing made of elastic material and provided between the shutter 5 and the rib 8 of the shutter frame 6 absorbs the noise of collision.

The shutter 5 preventing the outside air from entering from the discharging port 3 of the shutter device 19 may be made of resin. In this case, the shutter 5 can be made of the substantially same amount of resin material as the shutter 5 for resin molding, thereby hence reducing waste of the material and reducing the overall cost of the shutter device 19.

The shutter frame 6 and the shutter mount 4 may be formed unitarily. This arrangement allows both the shutter frame 6 and the shutter mount 4 to be implemented by a single component, and reduces the number of the components by at least one, thus reducing the number of assembling processes of the shutter device 19. For example, the shutter frame 6 and the shutter mount 4 may be fabricated at once by integral molding of resin material.

INDUSTRIAL APPLICABILITY

A shutter device according to the present invention is applicable to a system having ventilation or air conditioning functions for communicating between indoor and outdoor, and to a system including an outside air blocking shutter for ventilation, air blowing, or air conditioning.

The invention claimed is:

1. A shutter device comprising:

an intake port adapted to be connected with a side into which air enters;

a discharging port adapted to be connected with a side from which air is discharged;

a shutter mount provided between the intake port and the discharging port, the shutter mount having an inner diameter larger than a diameter of the discharging port;

a shutter for preventing air from entering from the discharging port;

a shutter frame inserted into an inside of the shutter mount so as to mount the shutter partially within a step between the shutter mount and the discharging port; and a shutter support shaft supporting the shutter, wherein the shutter frame includes a rib which contacts the shutter when the shutter is closed, so that the rib closes a gap between the shutter and the shutter mount, an upper end of the rib protrudes toward a side of the intake port with respect to the shutter support shaft, a lower end of the rib protrudes toward the side of the discharging port with respect to the shutter support shaft, within a range from the upper end to the step, portions of the rib which contact the shutter are positioned in an area from the step to the intake port, within a range from the lower end to the step, portions of the rib which contact the shutter are positioned in an area from the step to the discharging port, the shutter has an upper end configured to contact the upper end of the rib and a lower end configured to contact the lower end of the rib, the shutter has curved portions provided at left and right sides of the shutter and the curved portions protrude toward the intake port when the shutter is closed, the shutter support shaft is positioned at a side of the upper end of the rib between the upper end of the rib and the lower end of the rib, and the curved portions are provided between the shutter support shaft and the lower end of the shutter.

2. The shutter device according to claim 1, wherein the curved portions have shapes fitting a diameter of the discharging port when the shutter opens as seen from the discharging port, and the shutter frame includes contact rib portions having shapes matching with outer edges of the curved portions, the contact rib portions contacting the curved portions when the shutter is closed.

3. The shutter device according to claim 2, wherein an outer edge of each of the curved portions of the shutter has a shape asymmetrical about an axis which extends on a vertex of an outer edge of the curved portion and which is perpendicular to a surface of the shutter as seen from a side of the shutter, and a portion of the outer edge of each of the curved portions in a side including the shutter support shaft with respect to the axis has a smaller curvature radius.

4. The shutter device according to claim 2, wherein the curved portions of the shutter have shapes which match with the contact rib portions when the shutter is closed.

5. The shutter device according to claim 4, wherein an outer edge of each of the curved portions of the shutter has a shape asymmetrical about an axis which extends on a vertex of an outer edge of the curved portion and which is perpendicular to a surface of the shutter as seen from a side of the shutter, and a portion of the outer edge of each of the curved portions in a side including the shutter support shaft with respect to the axis has a smaller curvature radius.

6. The shutter device according to claim 5, wherein the shutter is made of metal, the shutter has an insertion aperture provided therein, the shutter support shaft being inserted into the insertion aperture, and the insertion aperture has a shape such that a burr produced when the insertion aperture is formed does not contact the shutter support shaft.

7. The shutter device according to claim 2, wherein the shutter is made of metal.

8. The shutter device according to claim 2, further comprising a packing provided on an outer edge of the shutter located in a direction perpendicular to an axis of the shutter support shaft, the packing adapted to absorb a collision.

9. The shutter device according to claim 2, wherein the shutter is made of resin.

10. A shutter device comprising:

an intake port adapted to be connected with a side into which air enters;

a discharging port adapted to be connected with a side from which air is discharged;

a shutter for preventing air from entering from the discharging port;

a shutter member including a shutter mount and a shutter frame, wherein the shutter mount and the shutter frame are unitarily formed, the shutter mount provided between the intake port and the discharging port, the shutter mount having an inner diameter larger than a diameter of the discharging port, the shutter frame disposed inside of the shutter mount between the shutter mount and the discharging port; and a shutter support shaft provided at a position at a side of the discharging port, the shutter support shaft supporting the shutter, wherein the shutter frame includes a rib which contacts the shutter when the shutter is closed, so that the rib closes a gap between the shutter and the shutter mount, an upper end of the rib protrudes toward a side of the intake port with respect to the shutter support shaft, a lower end of the rib protrudes toward the side of the discharging port with respect to the shutter support shaft, within a range from the upper end to a step between the shutter mount and the discharging port, portions of the rib which contact the shutter are positioned in an area from the step to the intake port, within a range from the lower end to the step, portions of the rib which contact the shutter are positioned in an area from the step to the discharging port, the shutter has an upper end configured to contact the upper end of the rib and a lower end configured to contact the lower end of the rib, the shutter has curved portions provided at left and right sides of the shutter and the curved portions protrude toward the intake port when the shutter is closed, the shutter support shaft is positioned at a side of the upper end of the rib between the upper end of the rib and the lower end of the rib, and the curved portions are provided between the shutter support shaft and the lower end of the shutter.

11. The shutter device according to claim 1, wherein the shutter is made of metal.

12. The shutter device according to claim 1, further comprising a packing provided on an outer edge of the shutter located in a direction perpendicular to an axis of the shutter support shaft, the packing adapted to absorb a collision.

13. The shutter device according to claim 1, wherein the shutter is made of resin.

14. A ventilation device comprising:

the shutter device according to claim 1, and a duct connected with the discharging port of the shutter device, wherein the intake port of the shutter device is connected with an exhausting opening for ventilation.

15. A shutter device comprising:

a shutter mount provided between an intake port and a discharging port, the shutter mount having an inner diameter larger than a diameter of the discharging port;

a shutter frame inserted into an inside of the shutter mount so as to mount a shutter with a shutter support shaft, the shutter support shaft provided at a portion of a step at a side of the discharging port and supporting the shutter, the step provided between the shutter mount and the discharging port; and a rib formed along the shutter frame so that an upper portion of the rib protrudes toward the intake port and a lower portion of the rib protrudes toward the discharging port with respect to the shutter support shaft, wherein the rib contacts the shutter at the upper portion and the lower portion of the rib so that the rib closes a gap between the shutter and the shutter frame when the shutter is closed, the shutter has an upper end configured to contact the upper end of the rib and a lower end configured to contact the lower end of the rib, the shutter has curved portions provided at left and right sides of the shutter and the curved portions protrude toward the intake port when the shutter is closed, the shutter support shaft is positioned at a side of the upper end of the rib between the upper end of the rib and the lower end of the rib, and the curved portions are provided between the shutter support shaft and the lower end of the shutter.

16. The shutter device according to claim 15, wherein the shutter has curved portions provided at left and right sides of the shutter, the curved portions have shapes fitting a diameter of the discharging port when the shutter opens as seen from the discharging port.

17. The shutter device according to claim 16, wherein the shutter frame includes contact rib portions having shapes matching with outer edges of the curved portions, the contact rib portions contacting the curved portions when the shutter is closed.

18. A shutter device comprising:

a shutter mount provided at a step between an intake port and a discharging port, the shutter mount having an inner diameter larger than a diameter of the discharging port;

a shutter for preventing air from entering from the discharging port;

a shutter frame inserted into an inside of the shutter mount so as to mount the shutter at the step; and a shutter support shaft provided at a portion of the step at a side of the discharging port, the shutter support shaft supporting the shutter, wherein the shutter frame includes a rib which contacts the shutter when the shutter is closed, the shutter has curved portions provided at left and right sides of the shutter, the curved portions have shapes fitting a diameter of the discharging port when the shutter opens as seen from the discharging port, the shutter frame includes contact rib portions having shapes matching with outer edges of the curved portions, the contact rib portions contacting the curved portions when the shutter is closed, and the rib includes an upper end which protrudes toward a side of the intake port with respect to the shutter support shaft, and a lower end which protrudes toward the side of the discharging port with respect to the shutter support shaft, the shutter has an upper end configured to contact the upper end of the rib and a lower end configured to contact the lower end of the rib, the shutter has curved portions provided at left and right sides of the shutter and the curved portions protrude toward the intake port when the shutter is closed, the shutter support shaft is positioned at a side of the upper end of the rib between the upper end of the rib and the lower end of the rib, and the curved portions are provided between the shutter support shaft and the lower end of the shutter.

19. A shutter device comprising:

an intake port at a side into which air enters;

a discharging port at a side from which air is discharged;

a shutter mounting portion provided between the intake port and the discharging port;

a shutter for preventing air from entering from the discharging port, the shutter mounted so as to be partially within a step between the shutter mounting portion and the discharging port; and a shutter support shaft supporting the shutter, wherein the shutter mounting portion includes a rib which contacts the shutter when the shutter is closed, an upper end of the rib protrudes toward a side of the intake port with respect to the shutter support shaft, a lower end of the rib protrudes toward the side of the discharging port with respect to the shutter support shaft, within a range from the upper end to the step, portions of the rib which contact the shutter are positioned in an area from the step to the intake port, and within a range from the lower end to the step, portions of the rib which contact the shutter are positioned in an area from the step to the discharging port, the shutter has an upper end configured to contact the upper end of the rib and a lower end configured to contact the lower end of the rib, the shutter has curved portions provided at left and right sides of the shutter and the curved portions protrude toward the intake port when the shutter is closed, the shutter support shaft is positioned at a side of the upper end of the rib between the upper end of the rib and the lower end of the rib, and the curved portions are provided between the shutter support shaft and the lower end of the shutter.

* * * * *